US007503945B2

(12) United States Patent
Hiltunen et al.

(10) Patent No.: US 7,503,945 B2
(45) Date of Patent: Mar. 17, 2009

(54) METHOD AND APPARATUS FOR GASIFYING CARBONACEOUS MATERIAL

(75) Inventors: Matti Hiltunen, Karhula (FI); Jorma Nieminen, Varkaus (FI); Katriina Nieminen, legal representative, Varkaus (FI)

(73) Assignee: Foster Wheeler Energia Oy, Helsinki (FI)

( * ) Notice: Subject to any disclaimer, the term of this patent is extended or adjusted under 35 U.S.C. 154(b) by 288 days.

(21) Appl. No.: 10/499,039

(22) PCT Filed: Dec. 20, 2002

(86) PCT No.: PCT/FI02/01052

§ 371 (c)(1),
(2), (4) Date: Aug. 26, 2005

(87) PCT Pub. No.: WO03/055962

PCT Pub. Date: Jul. 10, 2003

(65) Prior Publication Data

US 2006/0150510 A1 Jul. 13, 2006

(30) Foreign Application Priority Data

Dec. 21, 2001 (FI) ..... 20012567

(51) Int. Cl.

| | |
|---|---|
| ***B01J 7/00*** | (2006.01) |
| ***B01J 8/18*** | (2006.01) |
| ***H01M 8/06*** | (2006.01) |
| ***C01B 3/36*** | (2006.01) |
| ***C10J 3/46*** | (2006.01) |
| ***C10J 3/54*** | (2006.01) |
| ***F27B 15/00*** | (2006.01) |
| ***F27B 15/08*** | (2006.01) |

(52) U.S. Cl. ..... 48/61; 48/197 R; 422/139; 422/145

(58) Field of Classification Search ..... 48/197 R; 122/4 D; 422/139
See application file for complete search history.

(56) References Cited

U.S. PATENT DOCUMENTS 4,270,493 A 6/1981 Blaskowski ..... 122/7 R (Continued)

FOREIGN PATENT DOCUMENTS

WO WO 9424228 A1 * 10/1994
WO WO 00/43468 7/2000

*Primary Examiner*—Alexa D Neckel
*Assistant Examiner*—Matthew J Merkling
(74) *Attorney, Agent, or Firm*—Fitzpatrick, Cella, Harper & Scinto

(57) ABSTRACT

A method and an apparatus for gasifying carbonaceous material, in which (a) gasifying carbonaceous material is gasified in a gasification reactor of a gasification system to produce a product gas, (b) the product gas, ash particles entrained with the product gas, residual carbon, and gasified tar compounds are discharged from the gasification reactor to a product gas channel, (c) the product gas discharged from the gasification reactor is cooled using a gas cooler disposed along the product gas channel, so that the tar compounds are condensed to a liquid from that tends to stick to heat exchange surfaces of the gas cooler, (d) solid material including the ash particles and the residual carbon is separated from the gasification system, (e) the solid material separated from the gasification system is guided to an ash reactor, and oxygen-containing gas is supplied to the ash reactor, whereby the residual carbon in the solid material reacts with oxygen, and additional ash particles and exhaust gas are generated, and (f) ash particles from the ash reactor are guided along a conveying duct to the gas cooler or to a location upstream of the gas cooler, thereby increasing the ash content of the product gas and decreasing the tendency of the condensed tar compounds to stick to the heat exchange surfaces of the gas cooler.

12 Claims, 2 Drawing Sheets

U.S. PATENT DOCUMENTS

| | | | | |
|---|---|---|---|---|
| 4,347,064 | A | 8/1982 | Reh et al. | 48/197 R |
| 4,613,344 | A | 9/1986 | Henrich et al. | 48/77 |
| 4,823,742 | A | 4/1989 | Davis et al. | 122/7 R |
| 4,969,930 | A * | 11/1990 | Arpalahti | 48/197 R |
| 5,282,430 | A * | 2/1994 | Nehls, Jr. | 110/345 |
| 5,658,359 | A | 8/1997 | Berg et al. | 48/197 R |
| 6,214,065 | B1 | 4/2001 | Berg | 48/197 R |

* cited by examiner

METHOD AND APPARATUS FOR GASIFYING CARBONACEOUS MATERIAL

BACKGROUND OF THE INVENTION

The present invention relates to a method and an apparatus for gasifying carbonaceous material.

More particularly, the present invention relates to a method of gasifying carbonaceous material, in which carbonaceous material is gasified to produce a product gas in a gasification reactor of a gasification system. The product gas and ash entrained therewith, residual carbon, and gaseous tar compounds are discharged from the gasification reactor to a product gas channel. There, the product gas is cooled in a gas cooler, whereby the tar compounds condense into a liquid form, which tends to stick on surfaces. Solid material containing ash particles and residual carbon is separated from the gasification system and guided to an ash reactor. Oxygen-containing gas is supplied to the ash reactor, whereby the residual carbon reacts with oxygen to generate ash particles and exhaust gas.

The invention also relates to an apparatus for gasifying carbonaceous material. The apparatus comprises a gasification system including a gasification reactor, a product gas channel connected to the gasification reactor, a gas cooler arranged in the product gas channel, and means for separating solid material containing ash particles and residual carbon from the gasification system. The apparatus also includes an ash reactor having means for treating residual carbon in the ash reactor with oxygen, and means for supplying the solid material separated from the gasification system to the ash reactor.

When gasifying carbonaceous fuel, air and/or oxygen as well as steam are supplied to the gasification reactor, whereby the aim is to generate product gas mainly consisting of carbon monoxide (CO) and hydrogen ($H_2$).

To bring about endothermic reactions generating carbon monoxide and hydrogen, heat must be either released from the fuel by means of partial combustion or it must be brought to the gasification reactor in the form of an external heat exchange medium. When the gasification is not complete, a portion of the carbon in the fuel exits with the product gas as non-gasified char. The gasification temperature, especially with fluidized bed gasifiers, is often relatively low, e.g., 500-1000° C., such that the non-gasified carbon may significantly reduce the gas production level of the gasifier.

The product gas leaving the gasification reactor generally contains ash particles, which must be removed, for example, by a particle filter, before further processing the product gas. Since particle filters for gas operating at a high temperature are expensive and are prone to be damaged, the product gas is usually cooled prior to filtering. Especially, when gasifying waste material and biomass, significant amounts of tar compounds may be generated, which are gaseous at the gasification temperature, but condense at lower temperatures into sticky drops and even into solid particles. The condensed tar compounds may, for example, form deposits on the heat exchange surfaces of the gas cooler and on the filter, which are difficult to remove. Thus, the tar compounds decrease the heat exchange capacity of the heat exchange surfaces and clog filtering elements of the filter, thereby increasing the pressure loss caused by the filter.

U.S. Pat. No. 5,658,359 discloses a method in which heat exchange surfaces of a gas cooler in a fluidized bas gasifier are mechanically cleaned of deposits by passing bed sand, limestone, or a material separated from the product gas by a particle filter downstream of the gas cooler, to the heat exchange surfaces.

U.S. Pat. No. 4,613,344 discloses a method in which the sticking of impurities of the product gas is prevented by quickly cooling the gas through critical temperature zones. Cooling of the gas is accelerated by adding an inert material, e.g., aluminiumoxide ($Al_2O_3$), to the product gas in the gas cooler, which material is separated from the product gas downstream of the gas cooler by a centrifugal separator, cooled in a heat exchanger fluidized by the product gas, and recirculated to the product gas.

Solid material separated from the product gas, e.g., by a particle filter, may contain, in addition to ash, a considerable amount of char. The fly ash and bottom ash of the gasification reactor may also contain PAH compounds and other carbon compounds harmful to the environment. Thus, the ash removed from the gasification system must usually be post-treated before it may be gathered to public landfill sites or utilized as an industrial or agricultural raw material, for example.

International Patent Publication No. WO 00/43468 discloses a method in which carbonaceous solid material collected from the product gas filter of a fluidized bed gasifier is oxidizing in another fluidized bed reactor, and the oxygen-containing gas discharging from the reactor is guided to the fluidized bed gasifier to act as a secondary gasification gas.

U.S. Pat. No. 4,347,064 discloses a method in which partially gasified material collected from the separators of a circulating fluidized bed gasifier is brought to the final gasification in another gasifier, the product gas of which is supplied to act as a fluidization gas in a circulating fluidized bed gasifier.

SUMMARY OF THE INVENTION

An object of the present invention is to provide a method and an apparatus that improves the usability of a gasification system for carbonaceous material.

It is especially an object of the present invention to provide a simple method and apparatus for avoiding problems caused by tar compounds entrained with the product gas.

To solve these problems, a method is provided, wherein ash particles are guided from an ash reactor along a conveying duct to a gas cooler or to a location upstream of the gas cooler, thereby increasing the ash content of the product gas and reducing the amount of condensing tar compounds sticking to the heat exchange surfaces of the gas cooler.

Ash particles are preferably supplied from the ash reactor to an upper part of a gasification reactor and, most preferably, directly to a product gas channel, whereby the ash particles prevent as efficiently as possible the sticking of tar compounds.

To solve the above-mentioned problems of the prior art, an apparatus is also provided, comprising means for guiding ash particles treated in an ash reactor from the ash reactor to a gas cooler or to a location upstream of the gas cooler.

The apparatus preferably comprises means for guiding ash particles treated in the ash reactor from the ash reactor to an upper part of a gasification reactor and, most preferably, means for guiding them from the ash reactor directly to a product gas channel.

The gasification reactor of a gasification system according to a preferred embodiment of the present invention is a fluidized bed gasifier, but it may also be some other kind of a gasifier, for example, a fixed-bed gasifier or a dust gasifier.

The fluidized bed gasifier may either be a circulating fluidized bed gasifier or a bubbling bed gasifier. The gasifier may operate, for example, at a temperature of 400-1100° C. According to a preferred embodiment, the gasifier operates at a temperature of about 600-1000° C., and, according to a most preferred embodiment, at a temperature of about 800-950° C.

Generally, solid material containing ash particles and residual carbon is separated from the gasification system both as so-called bottom ash from the bottom of the gasifier and as so-called fly ash from the product gas. Solid material may also be separated from the hot cycle of the circulating fluidized bed gasifier. According to the present invention, it is possible to guide flows of solid material in any of the above-mentioned ways to the ash reactor.

According to a most preferred embodiment of the invention, impurities are separated from the product gas in a filter, whereby filtered product gas as well as solid material containing residual carbon and ash separated from the product gas are obtained. The solid material is guided to the ash reactor. The average particle size of the solid material separated in the filter is relatively small, whereby it forms ash in the ash reactor having a large surface area on which the tars can condense. When the surface area is large, the thickness of the condensed tar on the surface of the ash particles remains small, such that the particles are not sticky and do not stick to the heat exchange surfaces or to each other.

In an ash reactor in accordance with the present invention, it is possible to let the residual carbon react with oxygen, whereby the carbon is either combusted or completely gasified. In combustion, carbon reacts with oxygen and generates carbon dioxide ($CO_2$) and flue gas containing oxygen. In gasification, carbon reacts with gasification gas containing only some oxygen, whereby at least carbon monoxide (CO) is generated.

Different types of reactors may be used as ash reactors, but according to a preferred embodiment of the invention, the ash reactor is a fluidized bed reactor, which may be either a circulating fluidized bed reactor or a bubbling bed reactor.

Ash may be conveyed from the ash reactor along the conveying duct to the gasification system, for example, pneumatically. Since the particle size of the solid material arriving in the ash reactor from the filter is small, typically less than 200 μm, ash from the ash reactor utilizing the fluidized bed principle is entrained with the fluidizing gas out of the reactor. According to a preferred embodiment of the invention, exhaust gas from the fluidized bed reactor and ash particles entrained therewith are guided to the gasification system, preferably to the product gas channel thereof.

It is possible to separate the coarsest portion of the ash particles entrained with the exhaust gas being guided to the gasification system, for example, by a centrifugal separator, whereby only the finest portion of the ash particles is guided with the exhaust gas to the gasification system. A portion of the coarsest ash separated from the exhaust gas may be returned to the ash reactor, and the rest may be removed to an ash hopper, for example, by means of a cooled screw conveyor. The separation efficiency of the exhaust gas separator of the ash reactor should be chosen in such a way that a sufficient portion, preferably the majority of the ash entrained with the exhaust gas, remains unseparated and is entrained with the exhaust gas and carried to the product gas channel.

A fluidized bed reactor acting as an ash reactor can operate, for example, at a temperature of about 700-950° C. Preferably, the ash reactor operates at a temperature of about 850° C. Heat exchange surfaces may be arranged inside the reactor, for example, to control the temperature of the ash reactor. According to a preferred embodiment of the present invention, the temperature of the ash reactor is adjusted by means of a gas cooler in the product gas channel. Thus, the energy being released in the ash reactor may be utilized in a simple manner, for example, to form steam needed in the gasification reactor.

According to a preferred embodiment of the present invention, ash particles that are guided along a conveying duct from the ash reactor to the gasification system, especially to the product gas channel thereof, are already cooled before being introduced to the product gas channel by utilizing a heat exchanger arranged along the conveying duct. Thus, the tendency of tar compounds in the product gas to condense on ash particles being returned from the ash reactor increases and the sticking of tar compounds on the heat exchange surfaces of the gas cooler in the product gas duct decreases.

A gas cooler in the product gas duct is used for cooling product gas and also ash entrained with the gas, preferably to a temperature of about 200-350° C. The cooled ash from both the ash reactor and the gasification reactor is separated from the product gas by means of a particle filter and is guided to the ash reactor. Since the temperature of the ash arriving from the filter is lower than that of the ash reactor, the temperature of the reactor may be adjusted by changing the amount of ash circulating through the separator, cooler, and filter, back to the ash reactor. The amount of the circulating ash may be adjusted by changing the proportion of the ash being removed from the system relative to the ash being separated by a separator of the ash reactor. When removal of the ash being separated is decreased, or when it is temporarily stopped completely, the amount of ash in the ash reactor and in the reactor-separator-cooler-filter-reactor cycle increases, and the temperature of the ash reactor decreases. Conversely, when removal of separated ash is increased, the amount of the ash in the reactor and in the cycle decreases, and the temperature of the reactor increases.

It is a characteristic feature of the present invention that the ash reactor generates ash material, which may advantageously be supplied to the product gas and thus problems caused by tar compounds in the product gas may be avoided. When the proportion of the ash in the impurities entrained with the product gas increases, the proportion of the tar compounds decreases and sticking of the impurities on the surfaces decreases. The ash content in the product gas is in the area of the ash coolers and the filter preferably at least 100 $g/m^3$. The ash material coming from the ash reactor is inert and the average particle size thereof is small, which makes it is especially advantageous for decreasing problems caused by the tar compounds.

When ash separated from the gasification system is recirculated from the ash reactor through the gas cooler and the particle filter for the product gas, it is possible to increase the average retention time of the ash in the ash reactor. Thus, the residual carbon of the ash may either be gasified or combusted almost completely. Meanwhile, hydrocarbon compounds of the solid material removed from the filter, which are harmful to the environment, are effeciently decomposed. By utilizing the present invention, the efficiency of the plant is thus increased and, at the same time, the usefulness of the material to be removed from the reactor is improved, for example, as an industrial raw material, or, alternatively, ash may be disposed of in landfill sites without environmental problems.

BRIEF DESCRIPTION OF THE DRAWINGS

The invention is discussed below, by way of example, with reference to the accompanying drawings, in which FIG. 1 schematically illustrates an apparatus in accordance with a preferred embodiment of the present invention.

DESCRIPTION OF THE PREFERRED EMBODIMENTS

Figure 1:
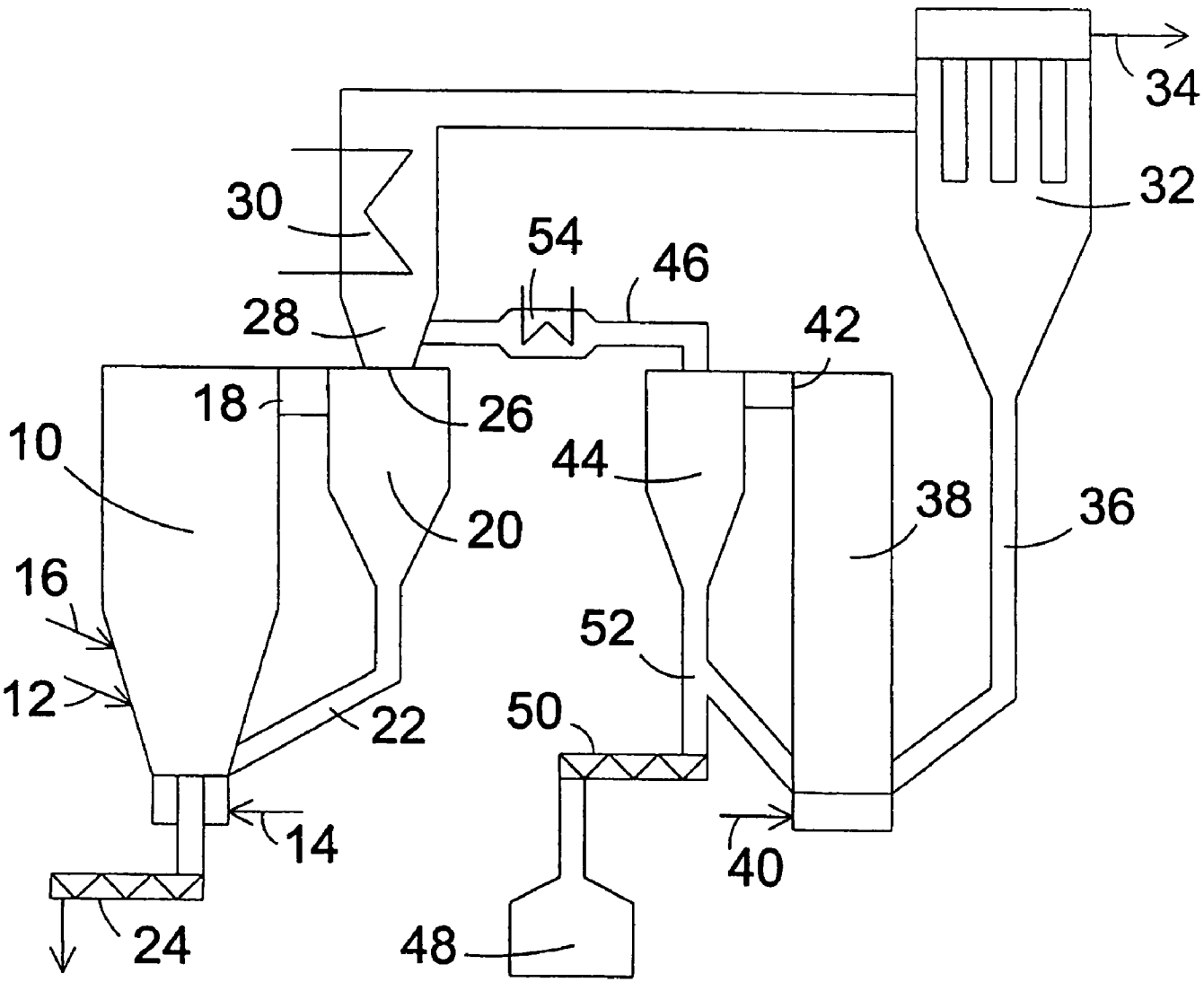

A gasification reactor 10 is disclosed in FIG. 1 as a circulating fluidized bed gasifier, but it might also be another type of a reactor suitable for gasifying fuel containing carbonaceous material. A material to be gasified, an inert bed material (e.g., sand), and, if necessary, a sorbent (e.g., lime stone), are supplied to the reactor 10 by feeding means 12.

Gasification gas, which acts as fluidizing gas, is introduced to the bottom of the gasifier by feeding means 14. The gasification gas may be air and/or oxygen, and possibly steam. Secondary gasification gas may be supplied to the fluidized bed of the gasifier by means 16. The fluidizing gases and the product gases generated in the reactor entrain therewith solid particles from the circulating fluidized bed reactor and carry them to the upper part of the reactor 10. In the upper part of the reactor, a portion of the solid material exits with the product gas through an outlet opening 18 to a particle separator 20. The majority of the solid material entrained with the product gas is separated therefrom in the particle separator 20 and is returned to a lower part of the reactor 10 by means of a return duct 22.

To release the energy required for endothermic gasification reactions, partial combustion of fuel takes place in the lower part of the gasifier. The gasification in a fluidized bed gasifier typically takes place within a temperature range of 600-1100° C., for example, at a temperature of 850° C. The lower part of the gasifier is provided with means for removing bottom ash, such means possibly comprising, for example, a cooled screw conveyor 24.

The product gas exiting through an outlet opening 26 of the particle separator 20 still contains impurities containing fine ash, ungasified residual carbon, tar compounds, and other carbon compounds, among which there may also be compounds harmful to the environment. Subsequent to the separator 20, the gas flow and the impurities contained therein are guided to a gas cooler 30 in a product gas channel 28. The temperature of the product gas is decreased in the gas cooler 30 to a temperature, for example, of about 200-350° C., as required by a particle filter 32 arranged in a downstream part of the product gas channel. The tar compounds entrained with the product gas, which are gaseous at the temperature of the gasification reactor, condense in the gas cooler 30 into small drops, which ten to stick on the heat exchange surfaces of the gas cooler and on surfaces downstream thereof.

The product gases are supplied from the gas cooler 30 to the particle filter 32, which very efficiently removes all non-gaseous impurities from the product gas. The cleaned product gas is guided from the particle filter 32 through an outlet channel 34 for combustion of the product gas, or for further processing, which may be, for example, reprocessing for a chemical process.

The solid material separated by the particle separator 32 is guided by means of an outlet pipe 36 to an ash reactor 38. Oxygen-containing reaction gas is supplied by feeding means 40 to the ash reactor 38. When the solid material reacts with the reaction gas, the residual carbon in the solid material either combusts to produce carbon dioxide ($CO_2$) or it gasifies to produce mainly carbon monoxide (CO). At the same time, the hydrocarbon compounds in the solid material, which are harmful to the environment, decompose to a form in which they are no longer harmful to the environment. Combustion of residual carbon generates heat energy and converts the ash of the gasifier to a form in which it may easily be utilized or collected. By gasifying the residual carbon it is possible to increase the gas yield of the plant.

The ash reactor 38 may be, for example, a circulating fluidized bed gasifier or a bubbling bed gasifier. The reaction gas to be supplied to the ash reactor 38 by means 40 fluidizes a solid material bed forming in the reactor, whereby the small ash particles of the bed are entrained with the exhaust gas generated in the reactor and carried through an outlet opening 42 of the reactor to a particle separator 44. The separation efficiency of the separator is chosen in such a manner that a sufficient amount of ash particles remain unseparated and are entrained with the exhaust gas and carried through a conveying duct 46 to the product channel 28. Due to the ash flow recirculated from the ash reactor 38, the ash content of the impurities entrained with the product gas in the product gas channel 28 increases considerably. This decreases the amount of the tar compounds condensing in the gas cooler 30 that stick on the surfaces.

According to a preferred embodiment of the present invention, the ash particles that are guided to the product channel 28 from the ash reactor 38 are cooled before being introduced to the product gas channel by utilizing a heat exchanger 54 arranged along the conveying duct 46. Thus, the tendency of the tar compounds in the product gas to condense on the ash particles being returned from the ash reactor 38 increases, and sticking of the tar compounds to the product gas channel 28, on the heat exchange surfaces of the gas cooler 30, and on the filter 32 decreases.

A portion of the particles separated by the separator 44 is returned to the ash reactor 38 and a portion is discharged to an ash hopper 48 by means of a cooled screw conveyor 50. The conveying velocity of the screw conveyor 50 determines how much of the ash being separated by the separator 44 is discharged from the system and how much is flown as overflow from a distribution chamber 52 back to the ash reactor 38. Due to the combustion or partial combustion of the residual carbon of the solid material, the temperature of the ash reactor 38 is preferably about 650-950° C., for example, 850° C. Since the solid material being returned from the filter 32 is at a lower temperature than the ash reactor 38, it is possible to adjust the temperature of the reactor by changing the amount of the ash recirculating through the ash reactor 38, gas cooler 30, and filter 32.

Figure 2:
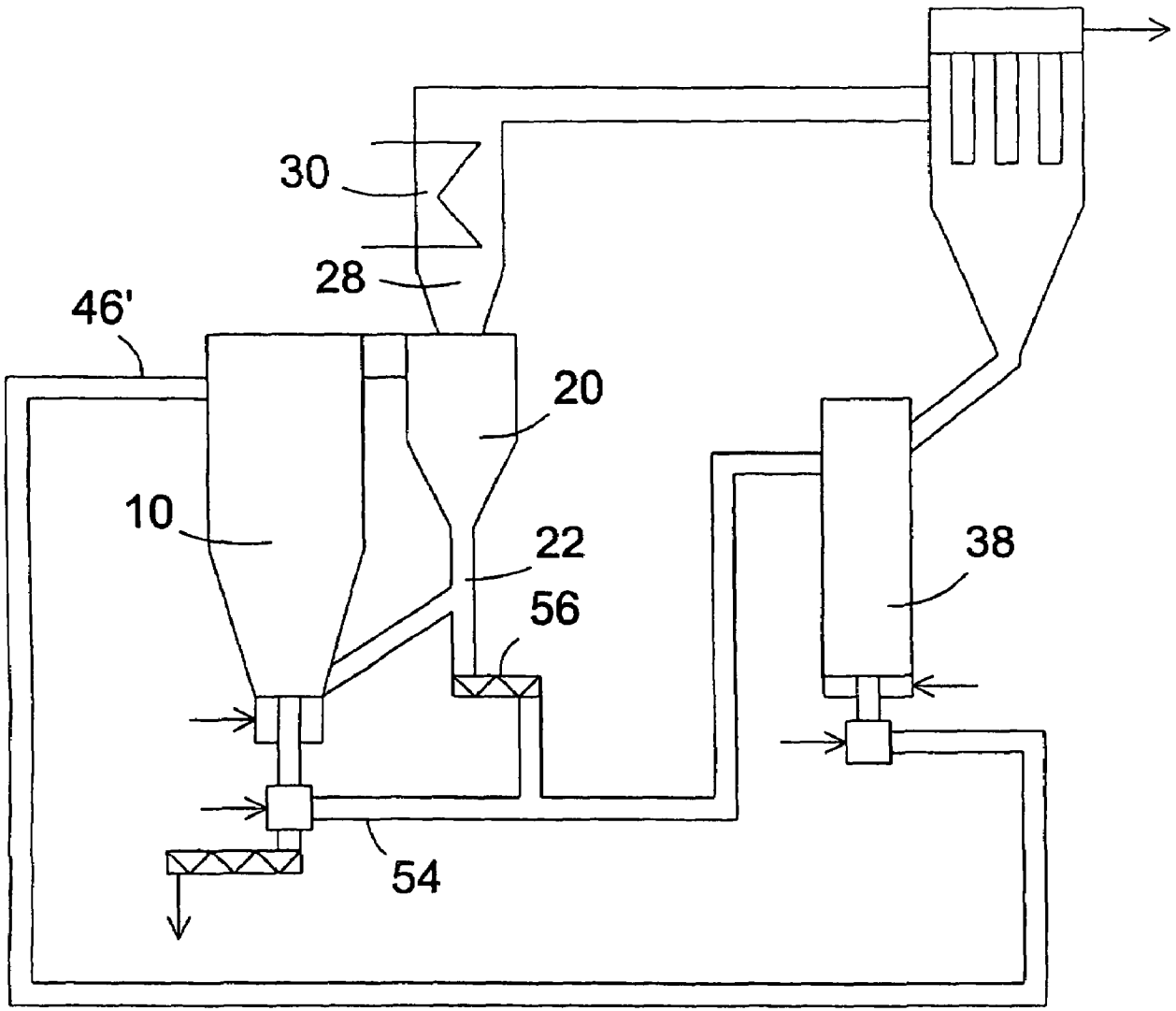
FIG. 2 schematically illustrates an apparatus in accordance with a second preferred embodiment of the present invention.

A second embodiment of the present invention is disclosed in FIG. 2. This embodiment differs from that of FIG. 1 in that, in addition to filter ash, the ash reactor 38 is also supplied with bottom ash of the gasification reactor 10 pneumatically along a conveyor pipe 54, as well as material separated from the return duct 22 of the particle separator 20 by means of a screw conveyor 56. Alternatively, it is possible to supply only bottom ash of the gasification reactor or only ash separated from the particle separator of the hot cycle, or different combinations of the above mentioned ash flows, to the ash reactor 38. In the embodiment disclosed in FIG. 2, ash treated in the ash reactor is pneumatically conveyed along a pipe 46' from the bottom of the ash reactor 38 to the upper part of the gasification reactor 10. Ash treated in the ash reactor may alternatively also be guided to the gas cooler 30 or elsewhere upstream of the gas cooler, for example, to the product gas channel 28.

In an embodiment according to FIG. 2, the average particle size of the ash being returned to the gasification system is bigger and the relative surface area is smaller than in the embodiment of FIG. 1. The advantage of bigger particles is that they have less of a tendency to stick on the surfaces of the product gas channel, so the embodiment of FIG. 2 is especially advantageous when the product gas contains especially sticky tar compounds, the amount of which is not very high.

While the invention has been herein described by way of example in connection with what are currently considered to be the most preferred embodiments, it will be apparent to those of ordinary skill in the art that many modifications and combinations may be made with respect to the disclosed embodiments. Thus, the invention covers several other applications included within the scope of the invention, as defined by the appended claims.

The invention claimed is:

1. An apparatus for gasifying carbonaceous material, said apparatus comprising:

a gasification system, including (i) a gasification reactor, (ii) a product gas channel leading away from the gasification reactor, (iii) a gas cooler disposed along the product gas channel, and (iv) means for separating solid material, including ash particles and residual carbon, from the gasification system;

an ash combustor, having means for combusting the residual carbon;

means for guiding the solid material separated from the gasification system to the ash combustor; and means for guiding ash particles from the ash combustor directly to one of (i) the gas cooler, and (ii) the product gas channel upstream of the gas cooler.

2. The apparatus of claim 1, wherein the means for guiding ash particles from the ash combustor guides the ash particles to the product gas channel.

3. The apparatus of claim 1, wherein the means for separating the solid material from the gasification system comprises a particle filter arranged in the product gas channel.

4. The apparatus of claim 1, wherein the gasification reactor is a fluidized bed gasifier.

5. The apparatus of claim 4, wherein the gasification reactor is a circulating fluidized bed reactor.

6. The apparatus of claim 1, wherein the ash combustor is a fluidized bed combustor.

7. The apparatus of claim 6, wherein the ash combustor is a circulating fluidized bed combustor.

8. The apparatus of claim 6, wherein the means for guiding ash from the ash combustor includes means for entraining the ash particles with exhaust gas generated in the ash combustor.

9. The apparatus of claim 8, further comprising means for separating a relatively coarse portion of the ash particles from the exhaust gas.

10. The apparatus of claim 9, wherein the means for separating the relatively coarse portion of the ash particles from the exhaust gas includes means for directing the relatively coarse portion of the ash particles to an ash hopper and means for returning the remainder of the ash particles to the ash combustor.

11. The apparatus of claim 1, wherein the means for guiding the ash particles includes means for cooling the ash particles.

12. An apparatus for gasifying carbonaceous material, said apparatus comprising:

a gasification system, including (i) a gasification reactor, (ii) a product gas channel leading away from the gasification reactor, (iii) a gas cooler disposed along the product gas channel, and (iv) a particle separator that separates solid material, including ash particles and residual carbon, from the gasification system;

an ash combustor including an oxygen feed for combusting the residual carbon;

a pipe leading from the particle separator to the ash combustor, through which the solid material separated from the gasification system is guided to the ash combustor; and a conveying duct leading from the ash combustor to one of (i) the gas cooler, and (ii) the product gas channel upstream of the gas cooler, through which ash particles from the ash combustor are guided directly to (i) the gas cooler, or (ii) the product gas channel upstream of the gas cooler.

* * * * *